US010833413B2

(12) United States Patent
Chou et al.

(10) Patent No.: US 10,833,413 B2
(45) Date of Patent: Nov. 10, 2020

(54) COMMUNICATION DEVICE

(71) Applicant: SILERGY SEMICONDUCTOR TECHNOLOGY (HANGZHOU) LTD., Hangzhou (CN)

(72) Inventors: Yupang Chou, New Taipei (TW); Chuohsun Sun, Taipei (TW)

(73) Assignee: Silergy Semiconductor Technology (Hangzhou) LTD, Hangzhou (CN)

( * ) Notice: Subject to any disclaimer, the term of this patent is extended or adjusted under 35 U.S.C. 154(b) by 106 days.

(21) Appl. No.: 16/110,261

(22) Filed: Aug. 23, 2018

(65) Prior Publication Data

US 2020/0021029 A1 Jan. 16, 2020

(30) Foreign Application Priority Data

Jul. 10, 2018 (TW) ..... 107123878 A

(51) Int. Cl.

| | |
|---|---|
| ***H01Q 9/04*** | (2006.01) |
| ***H01Q 1/38*** | (2006.01) |
| ***H01Q 9/40*** | (2006.01) |
| ***H01Q 21/28*** | (2006.01) |
| ***H01Q 1/24*** | (2006.01) |

(52) U.S. Cl.

CPC ..... *H01Q 9/0421* (2013.01); *H01Q 1/245* (2013.01); *H01Q 1/38* (2013.01); *H01Q 9/04* (2013.01); *H01Q 9/40* (2013.01); *H01Q 21/28* (2013.01)

(58) Field of Classification Search

CPC ..... H01Q 9/0421; H01Q 1/38; H01Q 9/40; H01Q 21/28; H01Q 1/245

USPC ..... 343/700 MS

See application file for complete search history.

(56) References Cited

U.S. PATENT DOCUMENTS

| | | | | |
|---|---|---|---|---|
| 8,552,916 | B2 * | 10/2013 | Hossain | H01Q 7/00 343/745 |
| 9,374,119 | B1 * | 6/2016 | Chou | H04B 1/3838 |
| 2013/0130633 | A1 * | 5/2013 | Lin | H01Q 1/245 455/127.1 |
| 2013/0241796 | A1 * | 9/2013 | Nagumo | H01Q 1/243 343/861 |
| 2014/0315606 | A1 * | 10/2014 | You | H01Q 1/245 455/575.5 |
| 2015/0295318 | A1 * | 10/2015 | Chiu | H01Q 1/245 343/745 |
| 2016/0087343 | A1 * | 3/2016 | Chang | H01Q 5/378 343/720 |
| 2017/0084985 | A1 * | 3/2017 | Ku | H01Q 1/243 |

* cited by examiner

*Primary Examiner* — Hai V Tran

(57) ABSTRACT

A communication device comprises a plurality of antennas, a sensing unit, a plurality of radio frequency circuits, and a sensing module. The sensing unit is electrically connected to the ground through at least one grounding capacitor, and the sensing unit is further configured to isolate and be coupled to each antenna. Each the radio frequency circuit is electrically connected to the corresponding each antenna. The sensing module is electrically connected to the sensing unit through an inductor, wherein the sensing module is used to sense the distance between the sensing unit and an external object by the sensing unit, and the sensing module generates a distance signal according to the distance.

10 Claims, 8 Drawing Sheets

COMMUNICATION DEVICE

RELATED APPLICATIONS

The present application claims the priority of Taiwan Application No. 107123878, filed Jul. 10, 2018, the disclosure of which is hereby incorporated by reference herein in its entirety.

BACKGROUND OF THE INVENTION

1. Field of the Invention

The present disclosure generally relates to a communication device, and, more particularly, to a communication device with multiple antennas of the same frequency band or different frequency bands.

2. Description of the Related Art

In general, in order to satisfy various wireless transmission specifications and MIMO (Multiple Input and Multiple Output) technologies in the present and in the future development, a plurality of antennas of the same or different frequency bands are usually installed in an electronic product with communication function to cover the same or different frequency bands. However, it is necessary to isolate the plurality of antennas of the same frequency band or different frequency bands in space-limited communication electronic products so that communication function of the plurality of antenna will not be affected by mutual interference between each other.

On the other hand, a large amount of electromagnetic waves are generated to affect the human body when using antennas for wireless transmission. Therefore, communication electronic products must pass the Specific Adsorption Rate (SAR) test. In particular, the practice in the prior art is to use a sensing devices for each antenna, and then to reduce the output power of signals of each antenna when the sensing devices sense human body proximity, in order to pass the SAR test.

In the prior art, isolation devices and a plurality of sensing devices are installed to solve the above problems. This method will make the situation of limited space worse in communication electronics and increase difficulty of design. Therefore, how to provide a communication device capable of properly isolating a plurality of antennas in the same frequency band or different frequency bands and sensing proximity of a human body in a limited space has become an urgent problem in the industry.

SUMMARY OF THE INVENTION

In light of solving the foregoing problems of the prior art, one purpose of the present invention is to provide a communication device capable of properly isolating a plurality of antennas in the same frequency band or different frequency bands and sensing proximity of a human body in a limited space.

In order to achieve the above purposes, the communication device according to the present invention comprises a plurality of antennas, a sensing unit, a plurality of radio frequency circuits, and a sensing module.

The sensing unit is electrically connected to the ground through at least one grounding capacitor, and the sensing unit is further configured to isolate and be coupled to each antenna.

Each one of the plurality of radio frequency circuits is electrically connected to the corresponding each antenna. The sensing module is electrically connected to the sensing unit through an inductor, wherein the sensing module is used to sense the distance between the sensing unit and an external object by the sensing unit, and the sensing module generates a distance signal according to the distance.

In an embodiment, the plurality of antennas are monopole antennas or PIFA antennas.

In an embodiment, each PIFA antenna is electrically connected to the ground through a capacitor in series when the plurality of antennas are PIFA antennas.

In an embodiment, the sensing unit comprises a first portion and at least one second portion. The first portion is coupled to the plurality of antennas. The at least one second portion is electrically connected to the first portion, and the at least one second portion is used to isolate and be coupled to the plurality of antennas.

In an embodiment, each second portion is electrically connected to the ground through the corresponding grounding capacitor.

In an embodiment, the at least one second portion is disposed between the plurality of antennas.

In an embodiment, the communication device of the present invention further comprises a control module electrically connected with the sensing module and the plurality of radio frequency circuits, and the control module is used for receiving the distance signal and sending a control signal to control the plurality of radio frequency circuits.

In an embodiment, the control module is used to judge a distance between the sensing unit and the external object by the distance signal, and the control module sends a power control signal to the plurality of radio frequency circuits to reduce the output power of the radio frequency signal when the distance is less than a threshold.

In an embodiment, each radio frequency circuit is further electrically connected to the corresponding each antenna through a connection capacitor.

In particular, the sensing unit of the communication device according to the present invention is coupled to the plurality of antennas and is used as part of antenna communication. The sensing unit is further electrically connected to the ground through at least one grounding capacitor, so that the isolation between the antennas can be improved. Moreover, the sensing unit and the sensing module electrically connected through an inductor is used to sense the distance between the sensing unit and external objects. In other words, the sensing unit has a plurality of functions and corresponds to a plurality of antennas. Therefore, the number of components required in the prior art can be greatly reduced and the limited space can be saved. It sufficiently solves the problems of the prior art. In addition, the communication device according to the present invention further has a control module. The control module is used to receive distance signals and send control signals to control the plurality of radio frequency circuits. Also, the control module sends a power control signal to the plurality of radio frequency circuits to reduce the output power of the radio frequency signal according to the distance, so that the SAR test can be passed.

DETAILED DESCRIPTION

The present invention is described by the following specific embodiments. Those with ordinary skills in the arts can readily understand other advantages and functions of the present invention after reading the disclosure of this specification. Any changes or adjustments made to their relative relationships, without modifying the substantial technical contents, are also to be construed as within the range implementable by the present invention.

As used herein, "coupled" may mean that two or more elements are directly in physical or electrical contact with each other, or that they are indirectly in physical or electrical contact with each other. Moreover, "coupled" may also mean that two or more elements mutually operate or act with each other (not limited to physical or electrical contact).

Figure 1:
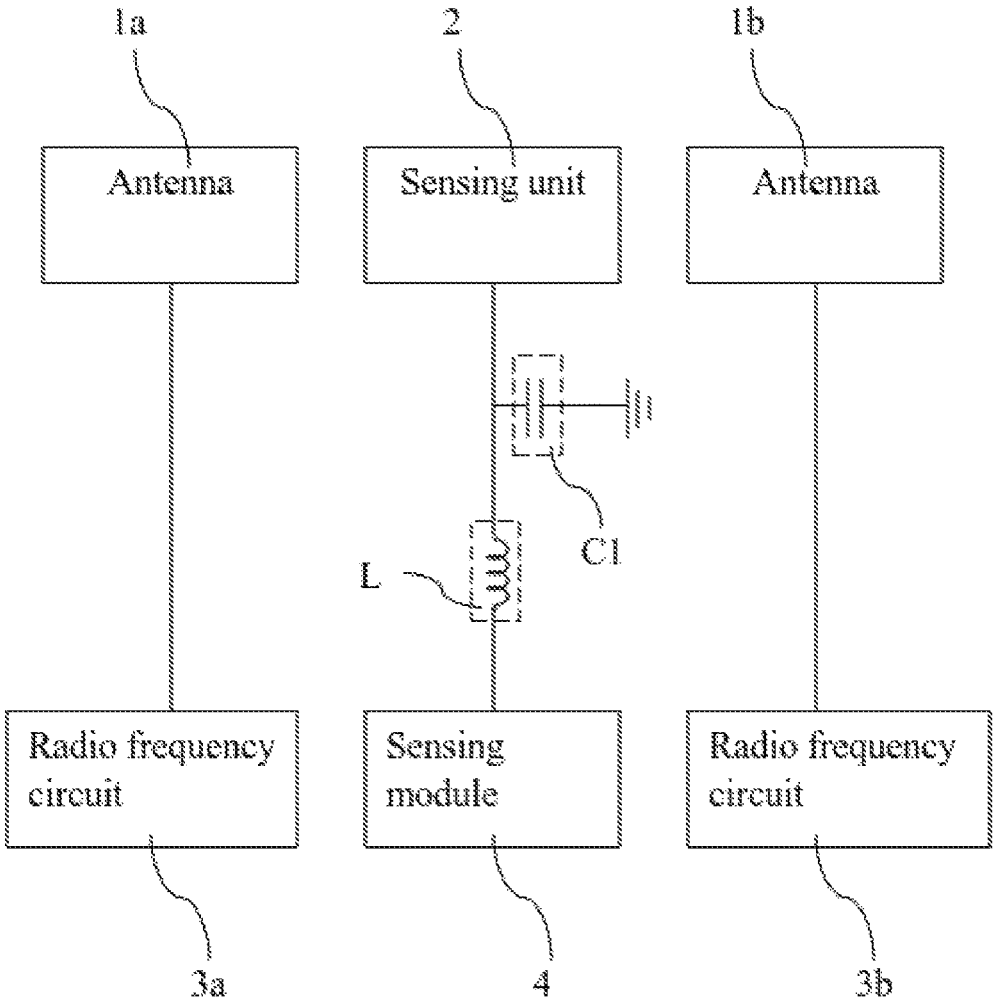
FIG. 1 illustrates a schematic diagram of a structure of a communication device according to a first embodiment of the present invention.

Please refer to FIG. 1. FIG. 1 illustrates a schematic diagram of a structure of a communication device according to a first embodiment of the present invention. As shown, a communication device according to the present invention includes a plurality of antennas 1*a*, 1*b*, a sensing unit 2, a plurality of radio frequency circuits 3*a*, 3*b*, and a sensing module 4. The communication device according to the present invention can be applied in electronic products with communication functions, such as mobile phones, tablet computers, wireless access point devices, etc.

For example, there are two antennas 1*a*, 1*b* in the embodiment of FIG. 1. However, there can be more antennas in another embodiment. The sensing unit 2 is electrically connected to the ground through at least one grounding capacitor C1, and the sensing unit 2 is further configured to isolate and be coupled to each antenna 1*a*, 1*b*. For example, the sensing unit 2 is disposed between the antenna 1*a* and the antenna 1*b*. The sensing unit 2 has an isolation effect because the sensing unit 2 is electrically connected to the ground through the grounding capacitor C1. Therefore the sensing unit 2 avoids or reduces mutual interference between antenna 1*a* and antenna 1*b*, to help setting up a plurality of antennas in a limited space.

In this embodiment, the radio frequency circuit 3*a* is electrically connected to the corresponding antenna 1*a*, and the radio frequency circuit 3*b* is electrically connected to the corresponding antenna 1*b*. The plurality of radio frequency circuits 3*a*, 3*b* are used to generate radio frequency signals and transmit the radio frequency signals through a plurality of antennas 1*a*, 1*b*. For example, the radio frequency circuits 3*a* generates a first radio frequency signal and transmit it to the antennas 1*a*, then the antennas 1*a* transmits the first radio frequency signal. The radio frequency circuits 3*b* generates a second radio frequency signal and transmit it to the antennas 1*b*. In addition, the plurality of antennas 1*a*, 1*b* may be antennas operating in the same or different frequency bands. For example, it can be high frequency band, low frequency band or specific frequency band (such as Long Term Evolution, LTE), but not limited thereto.

The sensing module 4 is electrically connected to the sensing unit 2 through an inductor L. The sensing module 4 is used to sense the distance between the sensing unit 2 and an external object by the sensing unit 2, and the sensing module 4 generates a distance signal according to the distance. For example, the external object can be a human body. When a human body approaches, it will induce a parasitic capacitance with the sensing unit 2. This causes the number of times of charging and discharging per second of the capacitance sensor in the sensor module 4 changed, thereby sensing the distance between the sensing unit 2 and the human body.

Figure 2A:
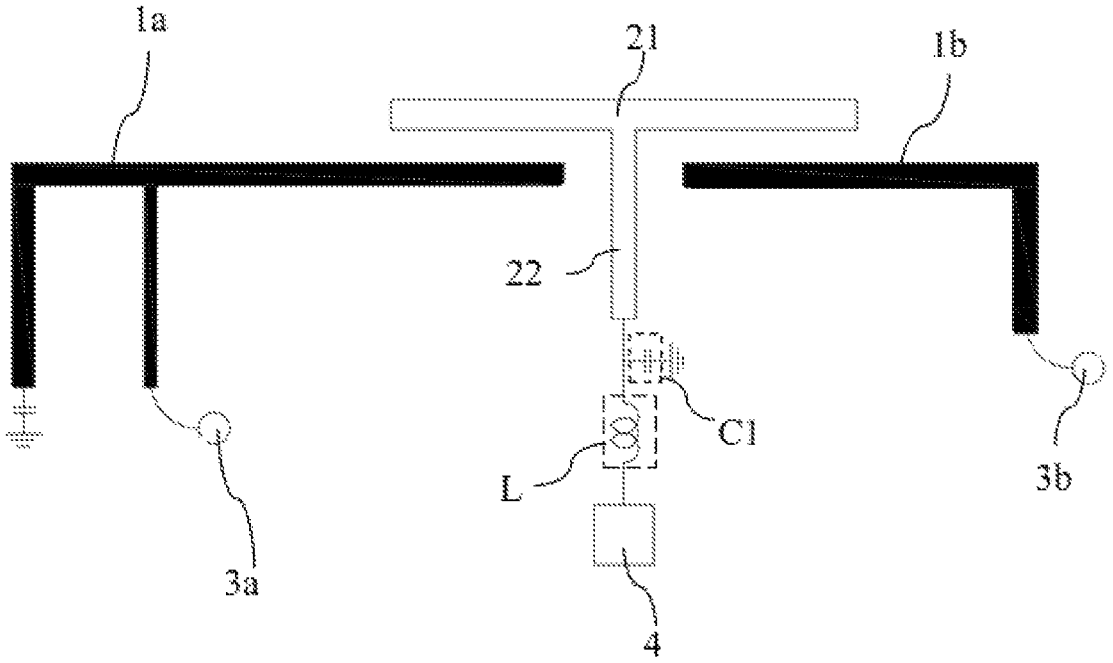
FIG. 2*a* illustrates a schematic diagram of a structure of a communication device according to a second embodiment of the present invention.
Figure 2B:
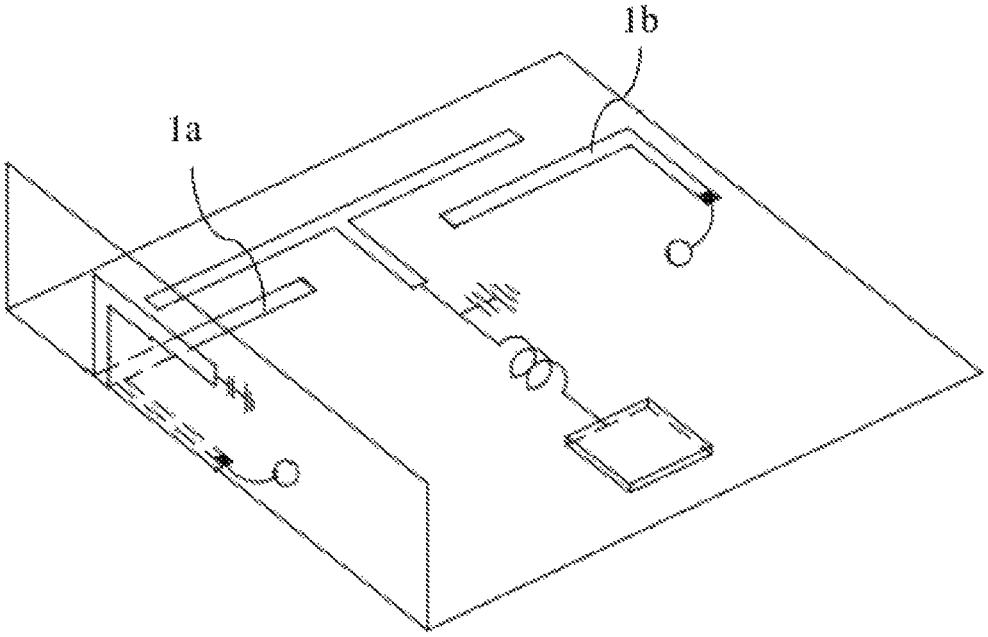
FIG. 2*b* illustrates a schematic diagram of a three-dimensional structure of a communication device according to a second embodiment of the present invention.

Please refer to FIGS. 2*a* and 2*b*. FIG. 2*a* illustrates a schematic diagram of a structure of a communication device according to a second embodiment of the present invention, and FIG. 2*b* illustrates a schematic diagram of a three-dimensional structure of a communication device according to a second embodiment of the present invention. For example, there are two antennas 1*a*, 1*b* in the embodiment of FIG. 2*a*. The antennas 1*a*, 1*b* correspond to radio frequency circuits 3*a*, 3*b* respectively. In an embodiment, the plurality of antennas are monopole antennas (such as the antenna 1*b*) or PIFA (Planar Inverted-F Antenna) antennas (such as the antenna 1*a*), but not limited thereto. It can change the design of the antenna according to the frequency band required for the actual application (such as WIFI or LTE). In addition, the plurality of antennas can be the same form or mix different forms. Each PIFA antenna is electrically connected to the ground through a capacitor in series when the plurality of antennas are PIFA antennas.

Further, as shown in FIG. 2*b*, the plurality of antennas is a three-dimensional structure. For example, the plurality of antennas (such as the antenna 1*a*) may be partially extended on the side housing to form a three-dimensional structure when the communication device according to the present invention is applied to a mobile phone or other electronic products.

Please refer to FIG. 2*a*. In an embodiment, the sensing unit 2 comprises a first portion 21 and at least one second portion 22. The first portion 21 is coupled to the plurality of antennas 1*a*, 1*b*. The at least one second portion 22 is electrically connected to the first portion 21, and the at least one second portion 22 is used to isolate and be coupled to the plurality of antennas 1*a*, 1*b*. For example, the first portion 21 is designed as a long strip and spanned and coupled to a plurality of antennas 1*a*, 1*b*. The second portion 22 is designed as a long strip electrically connected to the first portion 21. The number of second portions 22 is the number of antennas reduced by one. The second portion 22 is disposed between the plurality of antennas 1*a*. 1*b*. In this embodiment, the first portion 21 and the second portion 22 are not in physical or electrical contact with the plurality of antennas 1*a*, 1*b*, but not limited thereto. In another embodiment, the first portion 21 and the second portion 22 are in physical or electrical contact with a part or all of the plurality of antennas 1*a*, 1*b*.

In an embodiment, each second portion 22 is electrically connected to the ground through the corresponding grounding capacitor C1. In addition, the sensing module 4 is electrically connected to the second part 22 through the inductor L.

Figure 3A:
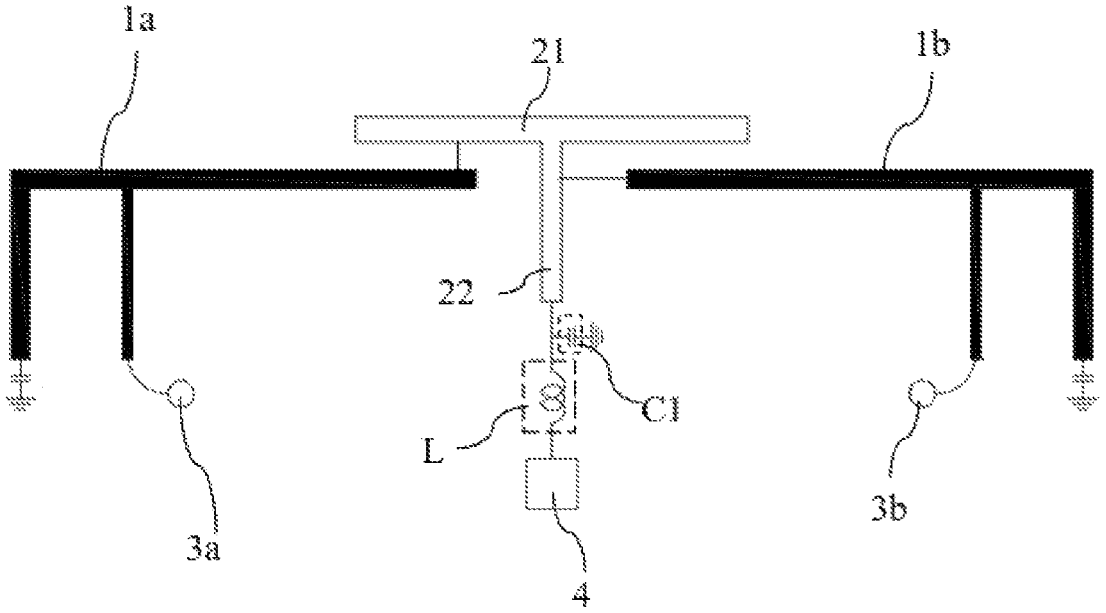
FIG. 3*a* illustrates a schematic diagram of a structure of a communication device according to a third embodiment of the present invention.
Figure 3B:
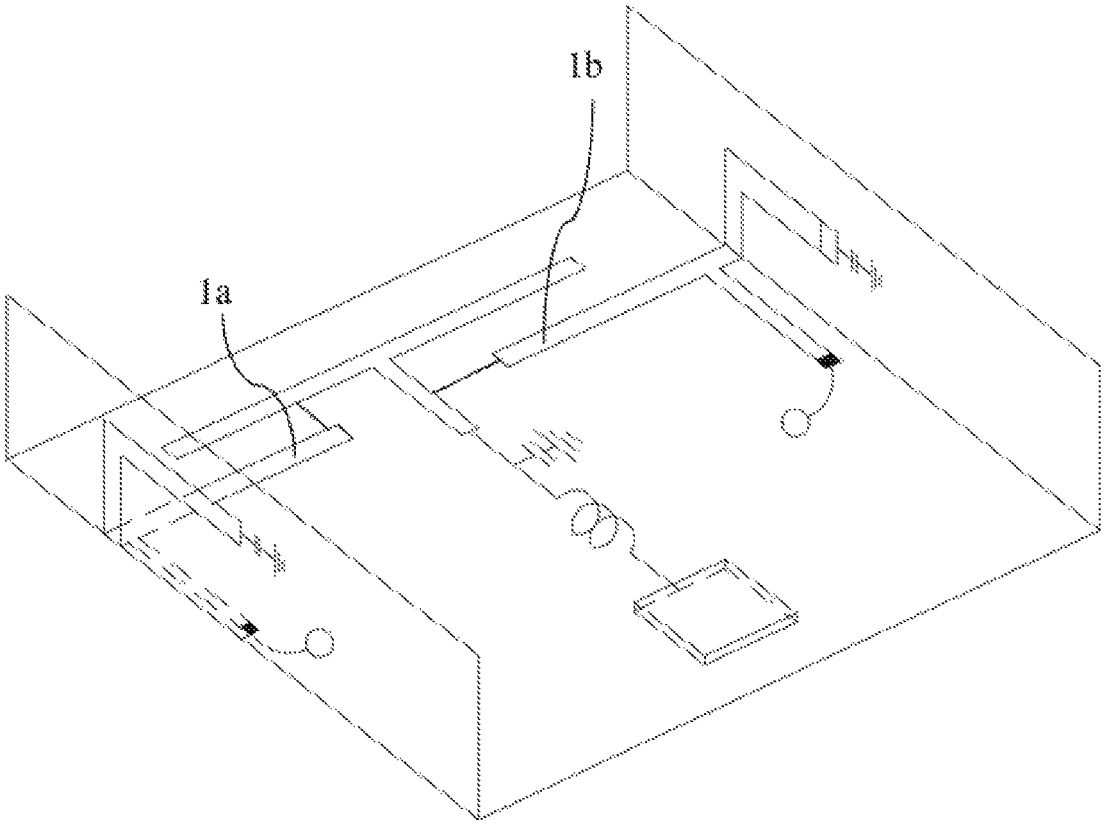
FIG. 3*b* illustrates a schematic diagram of a three-dimensional structure of a communication device according to a third embodiment of the present invention.

Please refer to FIGS. 3*a* and 3*b*. FIG. 3*a* illustrates a schematic diagram of a structure of a communication device according to a third embodiment of the present invention, and FIG. 3*b* illustrates a schematic diagram of a three-dimensional structure of a communication device according to a third embodiment of the present invention. For example, there are two antennas 1*a*, 1*b* in the embodiment of FIG. 3*a*. The antennas 1*a*, 1*b* are PIFA antennas. In this embodiment, the first portion 21 is in physical or electrical contact with the antenna 1*a*, and the second portion 22 is in physical or electrical contact with the antenna 1*b*, but not limited thereto. In another embodiment, the first portion 21 and the second portion 22 mutually operate or act with a part or all of the plurality of antennas 1*a*, 1*b*.

Further, as shown in FIG. 3*b*, the plurality of antennas is a three-dimensional structure. For example, the plurality of antennas (such as the antennas 1*a*, 1*b*) may be partially extended on the side housing to form a three-dimensional structure when the communication device according to the present invention is applied to a mobile phone or other electronic products.

Figure 4A:
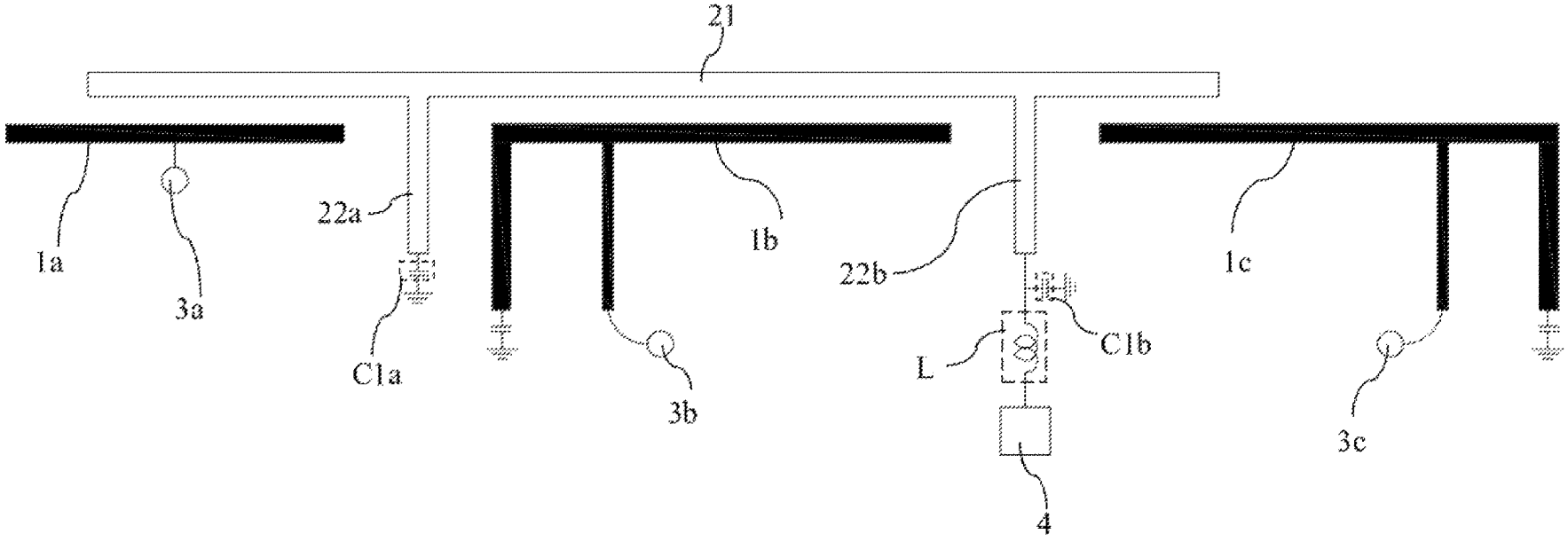
FIG. 4*a* illustrates a schematic diagram of a structure of a communication device according to a fourth embodiment of the present invention.
Figure 4B:
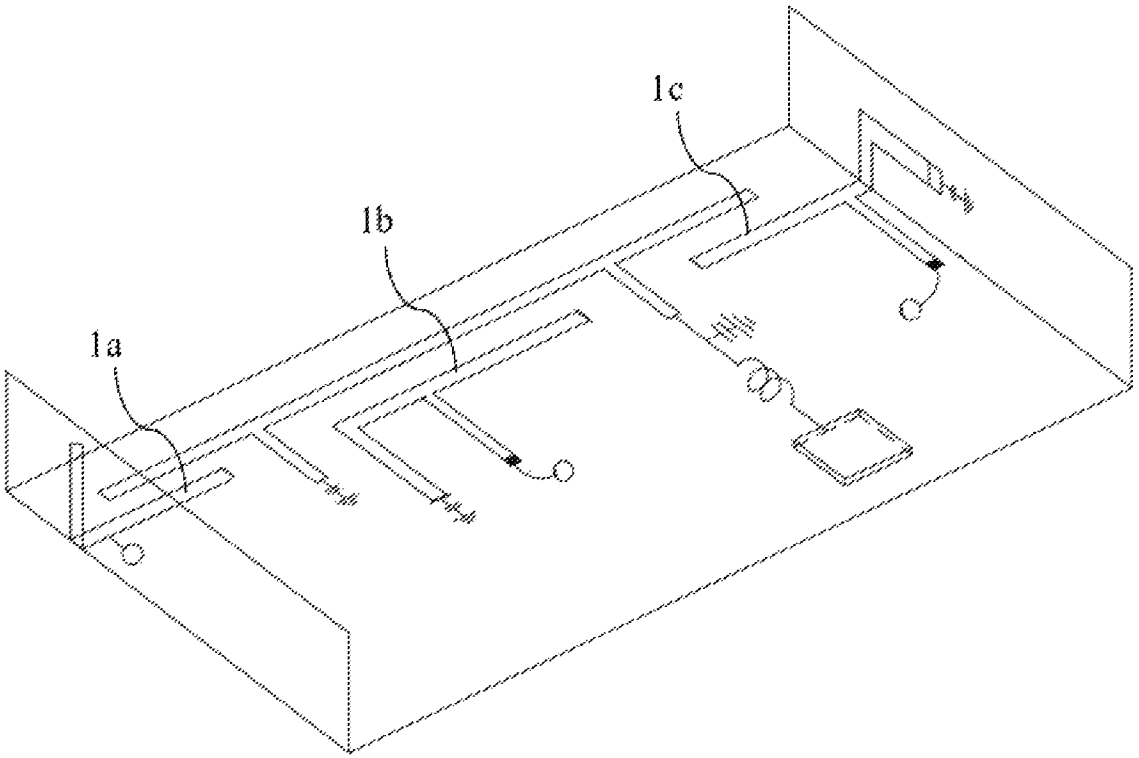
FIG. 4*b* illustrates a schematic diagram of a three-dimensional structure of a communication device according to a fourth embodiment of the present invention.

Please refer to FIGS. 4*a* and 4*b*. FIG. 4*a* illustrates a schematic diagram of a structure of a communication device according to a fourth embodiment of the present invention, and FIG. 4*b* illustrates a schematic diagram of a three-dimensional structure of a communication device according to a fourth embodiment of the present invention. For example, there are three antennas 1*a*, 1*b*, 1*c* in the embodiment of FIG. 4*a*. The antennas 1*a*, 1*b*, 1*c* correspond to radio frequency circuits 3*a*, 3*b*, 3*c* respectively. The antenna 1*a* is a monopole antenna and the antennas 1*b*, 1*c* are PIFA antennas. In another embodiment, there may be more antennas and the forms of the antennas may also have different arrangements.

In the embodiment of FIGS. 4*a* and 4*b*, the first portion 21 is designed as a long strip and spanned and coupled to a plurality of antennas 1*a*, 1*b*, 1*c*. Corresponding to three antennas 1*a*, 1*b*, 1*c*, there are two second portions 22*a*, 22*b* which are elongated structures electrically connected to the first portion 21 in the embodiment. The second portion 22*a* is disposed between the plurality of antennas 1*a*, 1*b*, and the second portion 22*b* is disposed between the plurality of antennas 1*b*, 1*c*.

In an embodiment, The second portion 22*a* is electrically connected to the ground through a corresponding grounding capacitor C1*a*, and the second portion 22*b* is electrically connected to the ground through a corresponding grounding capacitor C1*b*. In addition, the sensing module 4 is electrically connected to the second portion 22*b* through the inductor L, but not limited thereto. The sensing module 4 is electrically connected to the second portion 22*a* optionally.

Figure 5:
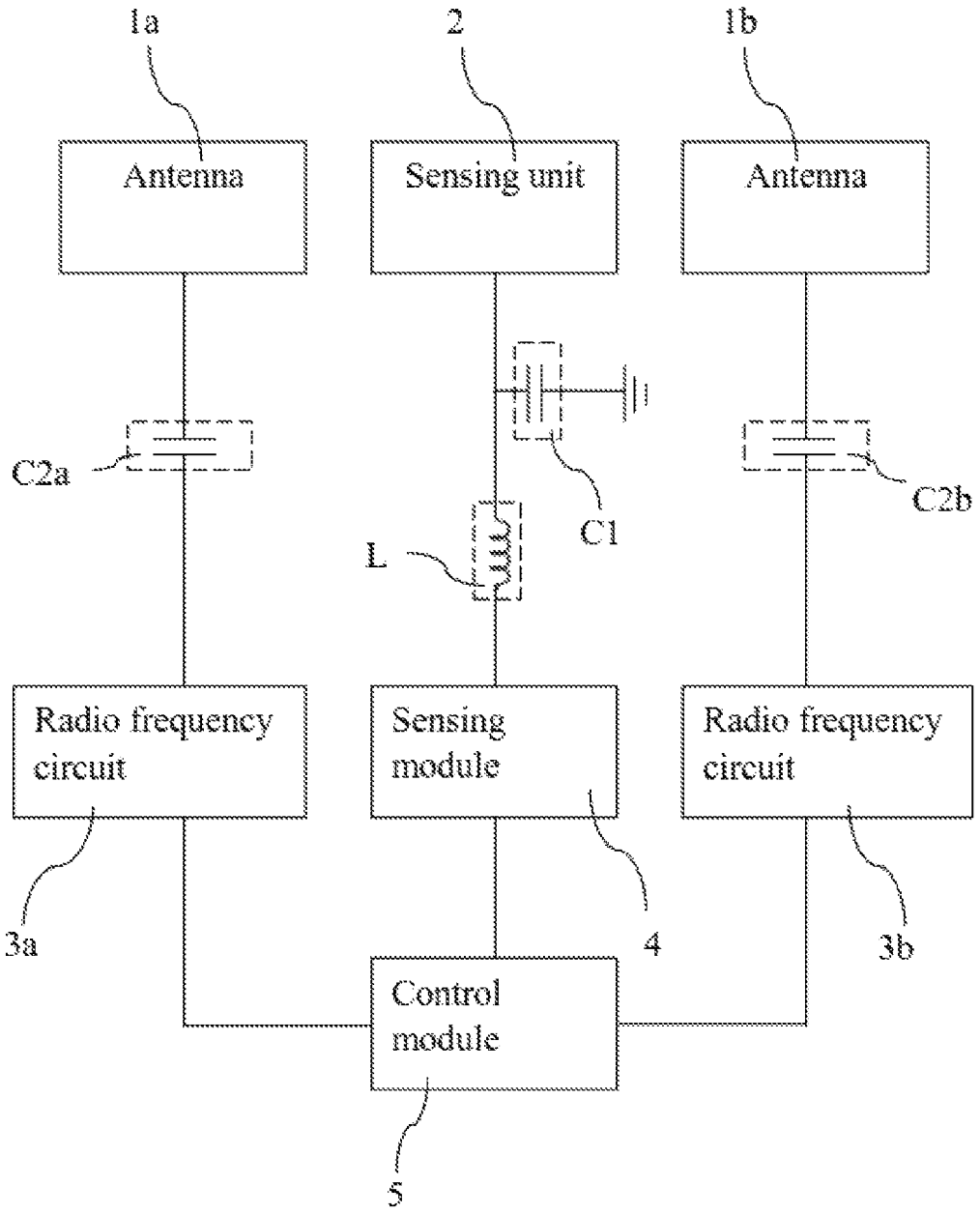
FIG. 5 illustrates a schematic diagram of a structure of a communication device according to a fifth embodiment of the present invention.

Please refer to FIG. 5. FIG. 5 illustrates a schematic diagram of a structure of a communication device according to a fifth embodiment of the present invention. In an embodiment, the communication device according to the present invention further comprises a control module 5 electrically connected with the sensing module 4 and the plurality of radio frequency circuits 3*a*, 3*b*. The control module 5 is used for receiving the distance signal and sending a control signal to control the plurality of radio frequency circuits 3*a*, 3*b*. For example, the control module 5 controls the frequency band or output power of the radio frequency signals of the plurality of radio frequency circuits 3*a*, 3*b* by the control signal. In another embodiment, the control module 5 also controls the on/off switch or the brightness of the mobile phone screen according to the distance signal.

In an embodiment, the control module 5 is used to judge a distance between the sensing unit 2 and the external object by the distance signal, and the control module 5 sends a power control signal to the plurality of radio frequency circuits 3*a*, 3*b* to reduce the output power of the radio frequency signal when the distance is less than a threshold. For example, the threshold can be 5 cm to 10 cm, but not limited thereto. When the external object (such as the human body) approaches and the distance between the sensing unit 2 and the external object is less than a threshold, the control module 5 makes the plurality of radio frequency circuits 3*a*, 3*b* reduce the output power of the radio frequency signal. Therefore the radiated power of the plurality of antennas 1*a*, 1*b* is also reduced. The degree of reduction is adjusted to satisfy the specification of SAR value and avoid harm to the human body.

Further, if the plurality of antennas 1*a*, 1*b* are disposed in a limited space and are close to each other (for example, less than 5 cm), Co-location SAR value detection is also performed. It means to detect all antennas 1*a*, 1*b*. At this time, the degree of reduction of the output power of the radio frequency signal is further adjusted, and the radio frequency circuit 3*a* and the radio frequency circuit 3*b* respectively reduce the output power at different levels.

In addition, a plurality of thresholds are set to form a plurality of intervals. Such that when the distance between the sensing unit 2 and the external object is in different intervals, the output power of the radio frequency signal is reduced in different degrees.

In an embodiment, each radio frequency circuit is further electrically connected to the corresponding each antenna through a connection capacitor. It set the output power of the RF signal from high to low according to the distance from far to near.

In an embodiment, the radio frequency circuit 3*a* is electrically connected to the corresponding antenna 1*a* through the connection capacitor C2*a*, and the radio frequency circuit 3*b* is electrically connected to the corresponding antenna 1*b* through the connection capacitor C2*b* to filter the low frequency signal.

In an embodiment, the radio frequency circuits, the sensing module, or the control module can be implemented by IC chips or PCB circuits.

In summary, the sensing unit of the communication device according to the present invention is coupled to the plurality of antennas and is used as part of antenna communication. The sensing unit is further electrically connected to the ground through at least one grounding capacitor, so that the isolation between the antennas can be improved. Moreover, the sensing unit and the sensing module electrically connected through an inductor are used to sense the distance between the sensing unit and external objects. In other words, the sensing unit has a plurality of functions and corresponds to a plurality of antennas. Therefore, the number of components required in the prior art can be greatly reduced and the limited space can be saved. It sufficiently solves the problems of the prior art. In addition, the communication device according to the present invention further has a control module. The control module is used to receive distance signals and send control signals to control the plurality of radio frequency circuits. Also, the control module sends a power control signal to the plurality of radio frequency circuits to reduce the output power of the radio frequency signal according to the distance, so that the SAR test can be passed.

The foregoing descriptions of the detailed embodiments are only illustrated to disclose the features and functions of the present invention and not restrictive of the scope of the present invention. It should be understood to those in the art that all modifications and variations according to the spirit and principle in the disclosure of the present invention should fall within the scope of the appended claims.

What is claimed is:

1. A communication device, comprising:

a plurality of antennas;

a sensing unit electrically connected to a ground through at least one grounding capacitor that is directly connected to the ground, the sensing unit being configured to isolate and couple to each of the plurality of antennas;

a plurality of radio frequency circuits, wherein each of the plurality of radio frequency circuits is electrically connected to a corresponding of each of the plurality of antennas; and a sensing module electrically connected to the sensing unit through an inductor, wherein the sensing module is used to sense a distance between the sensing unit and an external object, and wherein the sensing module generates a distance signal according to the distance.

2. The communication device of claim 1, wherein each of the plurality of antennas is a planar inverted-F (PIFA) antenna.

3. The communication device of claim 2, wherein the PIFA antenna is electrically connected to the ground through a capacitor in series.

4. The communication device of claim 1, wherein the sensing unit comprises:

a first portion coupled to the plurality of antennas; and at least one second portion electrically connected to the first portion, and the at least one second portion being used to isolate and be coupled to the plurality of antennas.

5. The communication device of claim 4, wherein each of the at least one second portion is electrically connected to the ground through a corresponding of the at least one grounding capacitor.

6. The communication device of claim 4, wherein the at least one second portion is disposed equidistant between the plurality of antennas.

7. The communication device of claim 1, further comprising a control module electrically connected with the sensing module and the plurality of radio frequency circuits, wherein the control module receives the distance signal and sends a control signal to control the plurality of radio frequency circuits.

8. The communication device of claim 7, wherein the control module is used to judge a distance between the sensing unit and the external object by the distance signal, and the control module sends a power control signal to the plurality of radio frequency circuits to reduce an output power of a radio frequency signal when the distance is less than a threshold.

9. The communication device of claim 1, wherein each of the plurality of radio frequency circuits is electrically connected to a corresponding of the plurality of antennas through a connection capacitor.

10. The communication device of claim 1, wherein each of the plurality of antennas is a monopole antenna.

* * * * *